United States Patent [19]

Stevenson

[11] Patent Number: 4,875,460

[45] Date of Patent: Oct. 24, 1989

[54] GRINDING WHEEL DRESSING APPARATUS

[76] Inventor: John Stevenson, 781 E. Golfview Dr., Roselle, Ill. 60172

[21] Appl. No.: 242,631

[22] Filed: Sep. 12, 1988

[51] Int. Cl.[4] ..... B24B 53/00

[52] U.S. Cl. ..... 125/11 DF; 125/39; 51/281 SF

[58] Field of Search ..... 51/5 D, 281 SF; 125/11 R, 11 GA, 11 DF, 11 NT, 11 B, 11 ST, 39

[56] References Cited

U.S. PATENT DOCUMENTS

| | | | |
|---|---|---|---|
| 1,468,357 | 9/1923 | Cumner et al. | 125/11 B |
| 1,483,748 | 2/1924 | Sanford | 125/11 R |
| 1,935,328 | 11/1933 | Munn | 125/11 B |
| 2,377,822 | 6/1945 | Starn | 125/11 R |
| 2,844,137 | 7/1958 | Rickenmann | 125/11 R |
| 4,494,522 | 1/1985 | Vasovich | 125/11 DF |
| 4,784,108 | 11/1988 | Johnson | 125/11.6 A X |

*Primary Examiner*—Robert P. Olszewski

*Attorney, Agent, or Firm*—Douglas B. White

[57] ABSTRACT

There is provided an improvement in a grinding wheel dressing apparatus of the type presenting opposing cutting tools to the side faces of the grinding wheel. A base supports dual towers having slide blocks carrying dressing tools mounted for controlled reciprocal motion. The slide blocks are in contact with end levers pivotally mounted to the towers for controlling the slide blocks. The end levers are positioned by a screw member upon which they travel and thereby provide leveraged accurate control of the slide blocks.

9 Claims, 2 Drawing Sheets

GRINDING WHEEL DRESSING APPARATUS

BACKGROUND OF THE INVENTION

1. Field of the Invention

The invention relates generally to apparatus for dressing grinding tools and more particularly to devices for simultaneously dressing both side faces of the grinding wheel with utmost control and accuracy.

2. Description of the Prior Art

In the prior art, apparatus has been developed for the dressing of the side faces of grinding wheels. Moreover, attention has been directed to dressing both sides at the same time to balance the stress on the wheel and to avoid the risk of breaking the wheel. U.S. Pat. No. 2,377,822 issued June 5, 1945, still represents the state of the art in those dressing tools and that device is still in use today.

In that patent there are provided two oppositely facing tool holders arranged to slide loosely on a support base. These tool holders are affixed to a screw mechanism used to move them toward the grinding wheel. While useful for many earlier applications, this apparatus does not provide sufficient control to obtain the accuracy required for modern precision grinding.

SUMMARY OF THE INVENTION

It is therefore a principal object of the present invention to provide a grinding wheel dressing apparatus of the type presenting opposing cutting tools to the side faces of the grinding wheel, and which provides greater control and accuracy than previously attainable.

Accordingly, there is provided a grinding wheel dressing apparatus having a base support and dual towers affixed thereto. End levers are pivotally mounted to the towers and arranged to travel at their lower extremity on a screw member extending through the fixed towers. Cutting tools are carried on slide blocks arranged in contact with the end levers and positioned to slide through the towers, to thereby move in response to controlled movement of the levers.

In a further aspect of the invention there is provided an improved screw mechanism having an adjustable length. This is accomplished with a split screw shaft contained within a tubular member.

While the invention will be described in connection with a preferred embodiment, it will be understood that I do not intend to limit the invention to that embodiment. On the contrary, I intend to cover all alternatives, modifications, and equivalents as may be included within the spirit and scope of the invention as defined by the appended claims.

DESCRIPTION OF THE PREFERRED EMBODIMENT

Figure 1:
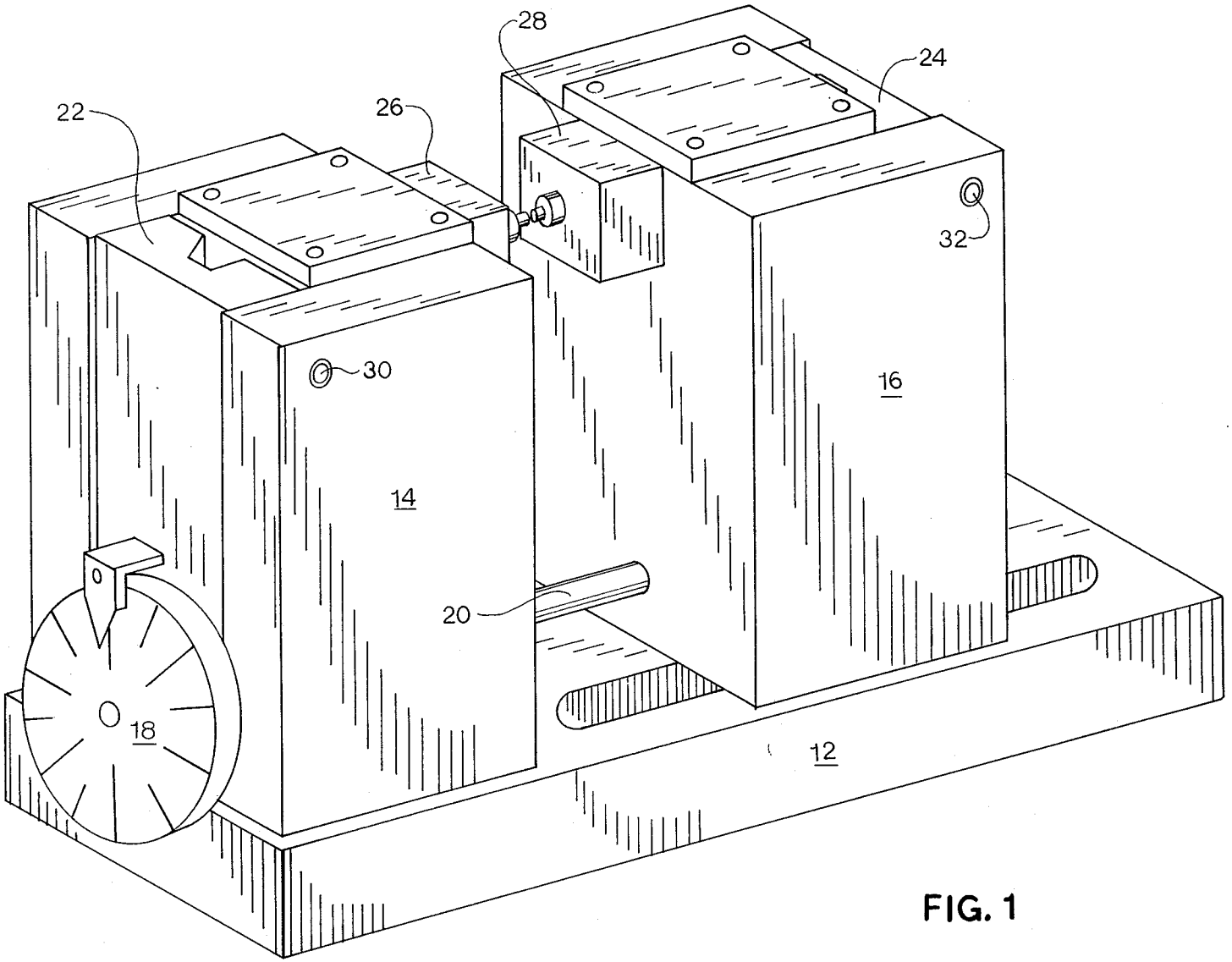
FIG. 1 is a perspective view of the grinding wheel dressing apparatus in accordance with the present invention showing a positioning dial arranged to turn a screw member to move end lever members in response thereto.

Turning first to FIG. 1 there is shown a grinding wheel dressing apparatus in accordance with the present invention. A base member 12 is shown having left and right tower members 14 and 16 rigidly affixed thereto. A positioning dial 18 is arranged to turn a screw member 20 in defined small radial increments to move end lever members 22 and 24 inwardly and outwardly in controlled response thereto.

Left and right slide blocks 26 and 28 are arranged to be driven by the upper portion of the lever members as they are, in turn, driven about their upper pivots 30 and 32. As a result, the slide blocks and the dressing tools carried thereon are urged toward each other and against a grinding wheel (not shown) interposed therebetween. (In a manner well known in the art, the grinding wheel is arranged to be driven about its axis and is mounted on an extending arm to facilitate its selective positioning within the dressing apparatus.)

Both slide blocks 26 and 28 are spring loaded against the respective lever members by springs 34 and 36 trapped within slots therefor and pressing against pins 37 and 38 protruding from the slide blocks. This removes slack from the system and further enhances accuracy. Protruding from the slide blocks at their outer extremities are contact pins 39 and 40. These are arranged to contact the end levers proximate the vertical centerline of the end lever pivots 30 and 32. In the preferred embodiment these slide block contact pins are formed to present a horizontal edge of small radius against the end levers for improved accuracy.

Figure 3:
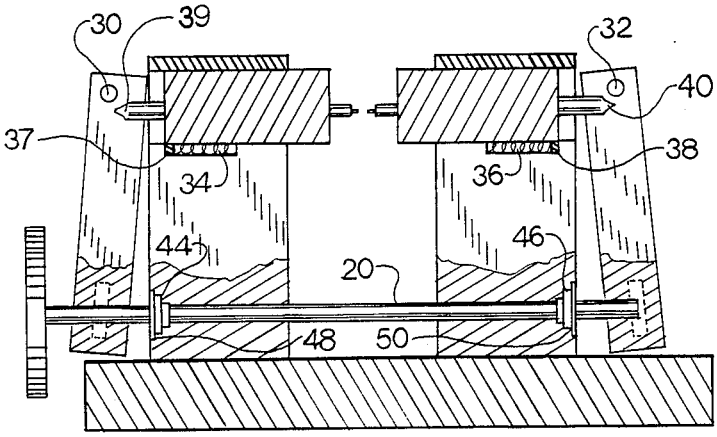
FIG. 3 is a side view of the grinding wheel dressing apparatus of the present invention showing the movement of the end lever members.
Figure 4:
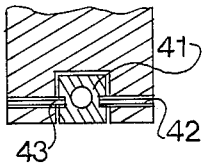
FIG. 4 is a partially cut away front view of the pin mounted pivoting coupling for mounting the end lever to the screw member. This coupling rotates on side pins and is threaded to travel on the screw member.

As shown in FIG. 3, the screw member operates to move the end levers about their pivots, with the lower portion of the levers traveling on the screw member. This lower portion of the lever members travels on the screw by a pin mounted pivoting coupling 41 (shown in detail in FIG. 4). This coupling rotates freely on side pins 42 and 43, and is threaded to mount on the screw member. In order to move the levers oppositely each end of the screw member and associated coupling is threaded in opposite directions.

Securing the screw member to the towers, while allowing rotational motion, are flanges 44 and 46 affixed to the screw member. These flanges rotate with the screw member but are trapped to prevent horizontal motion by imbedding the flanges into cavities within the towers and trapping the flanges therein with coverplates 48 and 50. As a result, requisite vertical movement is allowed within the tower cavities, to accomodate the slight vertical displacement resulting from the radial displacement of the end levers, but horizontal movement is prevented.

In accordance with this design of the present invention, control and accuracy may be determined by the screw thread and the leverage distance on the end levers from the screw to the pivot and the proximity of the slide block contact to the pivot. While these parameters may be adjusted mathematically by one skilled in the art, in the preferred embodiment the thread is set at 24 per inch and the end lever provides a leverage ratio of 100 to 1. As a result a radial movement of the dial of ⅛ turn produces an adjustment of the slide blocks of 50 millionths of an inch. Moreover, with this design flex of the components and slack in the mechanism is greatly reduced to further improve the accuracy.

Figure 5:
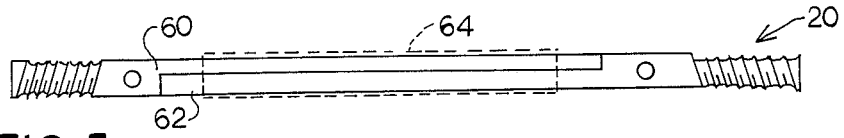
FIG. 5 is a side view of the screw member which is divided into two half round halves arranged to fit one on top of the other in order to achieve horizontal elongation. These two halves are secured in mating relationship by an encircling tubular member.
Figure 6:
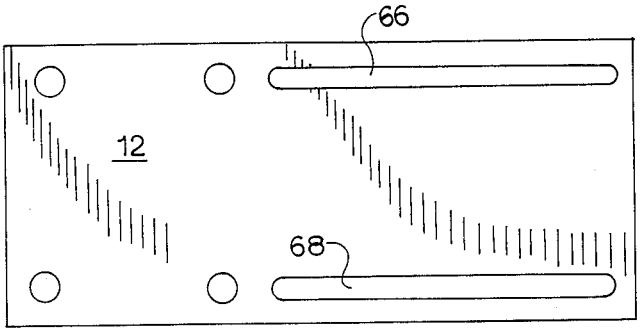
FIG. 6 is a plan view of the base plate showing positioning slots whereby one of the towers may be relocated along the base plate by moving the attaching bolts in the slots.

In yet a further aspect, the screw member is arranged for horizontal elongation which occurs during operation of the screw or repositioning of the towers. In its midsection the screw member is divided into two half round halves 60 and 62 arranged to fit one against the other. These two halves are secured in mating relationship by an encircling tubular member 64 (shown in phantom in FIG. 5). This allows the horizontal displacement as the halves slide relative to each other but retains the torsional rigidity. In conjunction with this feature, one of the towers may be relocated along the base member by moving the attaching bolts in slots 66 and 68 in the base (FIG. 6).

Figure 2:
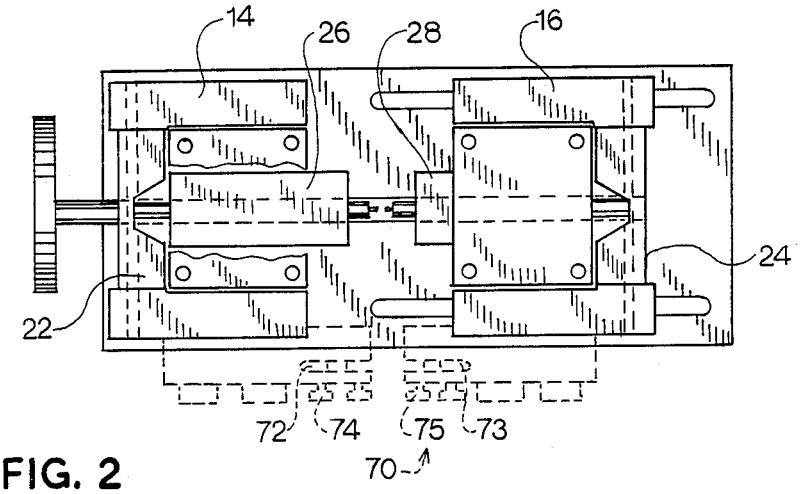
FIG. 2 is a top view of the grinding wheel dressing apparatus of the present invention showing the relationship of the slide blocks and the dressing tools as they are urged toward each other and against a grinding wheel (not shown) interposed therebetween.

In an ancillary feature, there is provided a mechanism 70 mounted on the side of the apparatus (shown in phantom in FIG. 2) for holding a coupon of material. A coupon of steel or other material is positioned within slots 72 and 73 of the holder and held in place by screws 74 and 75. By thus positioning this coupon, a dressed wheel may be brought into position and a slot cut in the coupon by the wheel without moving or changing the calibration of the apparatus. As a result, the cut in the coupon may be measured and adjustments to the dressing tool quickly determined without affecting the setting on the apparatus.

From the foregoing description, it will be apparent that modifications can be made to the apparatus and method for using same without departing from the teaching of the present invention. Accordingly the scope of the invention is only to be limited as necessitated by the accompanying claims.

I claim:

1. An apparatus for dressing grinding wheels comprising:

a base support;

first and second tower members affixed to said base support;

first and second end lever members pivotally mounted proximate their upper extremities to said first and second tower members respectively;

screw means arranged to extend through said tower members and to engage the lower extremities of said end lever members, whereby selective rotation of said screw means causes responsive pivotal movement of said end lever members; and first and second slide members each having a working extremity and a control extremity, arranged to carry abrasion means on said working extremity for dressing of the grinding wheel, said slide members being mounted for reciprocal motion within said first and second tower members respectively, and being positioned to contact said first and second end lever members respectively at their control extremities proximate said pivots of said end lever members, whereby pivotal movement of said end lever members causes controlled responsive movement of said slide members.

2. The apparatus for dressing grinding wheels of claim 1 further comprising first and second cavities defined in said first and second tower members respectively, and further comprising first and second flange members affixed to said screw member and entrapped within said respective cavities defined in said tower members, whereby horizontal motion of said screw member is prevented but vertical motion is allowed.

3. The apparatus for dressing grinding wheels of claim 1 further comprising pivot members arranged to travel on said screw member, wherein said pivot members are pivotally mounted within said end levers, to provide controlled movement of said end levers in response to movement of said screw member.

4. The apparatus for dressing grinding wheels of claim 1 wherein said screw member is longitudinally split in its center portion, and further comprising a tubular member encasing said center portion of said screw member, whereby longitudinal displacement is allowed but rotational engagement is maintained.

5. The apparatus for dressing grinding wheels of claim 4 wherein said first tower member is arranged to be adjustably repositioned along said base support.

6. The apparatus for dressing grinding wheels of claim 1 wherein said slide members present an edge contact to said end lever members.

7. The apparatus for dressing grinding wheels of claim 6 wherein said slide members are arranged to contact said end levers below said pivotal mount of said end lever.

8. The apparatus for dressing grinding wheels of claim 1 further comprising means for urging said slide blocks against said end lever members.

9. The apparatus for dressing grinding wheels of claim 1 further comprising a coupon holding device affixed to said apparatus for mounting a coupon in convenient proximity to said grinding wheel dressing.

* * * * *